US011938368B1

(12) United States Patent
Reynolds

(10) Patent No.: US 11,938,368 B1
(45) Date of Patent: Mar. 26, 2024

(54) EXERCISE BENCH WITH ADJUSTABLE BACKREST

(71) Applicant: Cap Barbell, Inc., Houston, TX (US)

(72) Inventor: Curt Reynolds, Tomball, TX (US)

(73) Assignee: Cap Barbell, Inc., Houston, TX (US)

( * ) Notice: Subject to any disclaimer, the term of this patent is extended or adjusted under 35 U.S.C. 154(b) by 0 days.

(21) Appl. No.: 18/066,921

(22) Filed: Dec. 15, 2022

(51) Int. Cl.
*A63B 21/00* (2006.01)

(52) U.S. Cl.
CPC .... *A63B 21/4029* (2015.10); *A63B 2225/093* (2013.01)

(58) Field of Classification Search
CPC ..... A63B 21/00047; A63B 21/078; A63B 21/4029; A63B 23/12; A63B 69/0062; A63B 2225/09
See application file for complete search history.

(56) References Cited

U.S. PATENT DOCUMENTS 6,152,866 A * 11/2000 Kuo ..... A63B 21/055 482/130
7,044,898 B2 * 5/2006 Kuo ..... A63B 21/4035 482/121
D541,893 S * 5/2007 Webber ..... D21/690
7,674,215 B1 * 3/2010 Swanson ..... A63B 23/00 482/142
8,206,272 B2 * 6/2012 Greene ..... A63B 22/0002 297/215.12
8,968,162 B2 * 3/2015 Jaguan ..... A63B 21/4035 482/57
2001/0018387 A1 * 8/2001 Webber ..... A63B 21/078 482/145
2007/0129225 A1 * 6/2007 Hammer ..... A63B 23/0211 482/121
2007/0149373 A1 * 6/2007 Dalebout ..... A63B 23/1209 482/142
2011/0195822 A1 * 8/2011 Donofrio ..... A63B 1/00 482/129
2016/0089558 A1 * 3/2016 Noyes ..... A63B 21/4029 482/130
2016/0213968 A1 * 7/2016 Boss ..... A63B 69/0062
2017/0216656 A1 * 8/2017 Leipheimer ..... A63B 69/0057
2018/0099176 A1 * 4/2018 Specht ..... A63B 21/4029
2018/0369633 A1 * 12/2018 Baker ..... A63B 23/0211
2019/0151699 A1 * 5/2019 Isom ..... A63B 21/00061
2020/0360764 A1 * 11/2020 Smith ..... A61H 1/00

* cited by examiner

*Primary Examiner* — Andrew S Lo
*Assistant Examiner* — Andrew M Kobylarz
(74) *Attorney, Agent, or Firm* — D'Ambrosio & Menon, PLLC; Usha Menon

(57) ABSTRACT

An adjustable exercise bench includes a vertical mounting bar with a plurality of pre-drilled holes and a backrest mounted to the mounting bar. The backrest can be moved upward or downward. In one embodiment, the backrest is bifurcated and has an adjustable head pad and an adjustable back pad. The head pad and back pad are configured for slidable upward and downward movement along the mounting bar. A lower surface of the head pad and an upper surface of the back pad are sized and shaped for a substantially close sliding reception with each other.

15 Claims, 7 Drawing Sheets

EXERCISE BENCH WITH ADJUSTABLE BACKREST

FIELD OF THE INVENTION

The present invention relates generally to exercise equipment. In particular, it pertains to an exercise bench having an adjustable backrest, and more particularly, to a height-adjustable backrest.

BACKGROUND

The background description includes information that may be useful in understanding the present invention. It is not an admission that any of the information provided herein is prior art or relevant to the presently claimed invention, or that any publication specifically or implicitly referenced is prior art.

An exercise bench, also known as a utility bench or a fitness bench, is an accessory that is typically used by those engaged in strength training. A user can engage in various exercises, such as, exercises using dumbbells, kettlebells or barbells, bench presses, and core work, while sitting or lying down on the exercise bench. The exercise bench facilitates proper posture so that the user can perform a workout correctly and, as such, is a very helpful piece of exercise equipment.

Conventional exercise benches can be flat or adjustable benches. Flat benches have a single cushion and do not have an adjustable back or seat. However, adjustable benches have an adjustable back and/or seat. The back and/or seat can be inclined or declined based on the user's requirements.

However, conventional adjustable exercise benches are manufactured according to standard specifications and are not configured to accommodate users of different heights. If the height of a user does not conform to a standard adjustable exercise bench, the user will have to contort themselves to try and fit their back and head on the backrest all the while trying to maintain safe and proper form during use. Therefore, while such users may still be able to use conventional adjustable exercise benches, it is not optimal from a safety or a proper form standpoint. Therefore, there is a need for an adjustable exercise bench that accommodates users of varying heights.

SUMMARY

An improved exercise apparatus is provided to solve the above-described limitations of conventional exercise benches presently known in the art. According to an embodiment, an exercise bench includes a vertical mounting bar with a plurality of pre-dilled holes and a bifurcated backrest mounted to the mounting bar. The bifurcated backrest has an adjustable head pad and an adjustable back pad. The back pad is positioned beneath the head pad on the mounting bar. The head pad and back pad are also configured for slidable movement along the mounting bar, and a lower surface of the head pad and an upper surface of the back pad are sized and shaped for a substantially close sliding reception with each other.

The vertical mounting bar is pivotally attached to a basal frame.

The adjustable exercise bench further comprises a seat. The seat can be an adjustable and/or slidable seat. The seat can be attached to the basal frame.

Each hole may be spaced apart at a substantially equal distance from an adjacent hole on the mounting bar.

The head pad is coupled to a first carriage piece, and the back pad is coupled to a second carriage piece.

The adjustable exercise bench also has a first and second securing pin. The first and second securing pins are selected from a group consisting of pop-pins and removable pins. The first carriage piece comprises at least one opening for receiving the first securing pin, and the second carriage piece comprises at least one opening for receiving the second securing pin.

The first securing pin is further configured to pass through a first hole on the mounting bar, and the second securing pin is configured to pass through a second hole on the mounting bar.

The first and second securing pins are coupled to rotatable knobs. Rotating the knobs in a first direction causes the first and second securing pins to be loosened such that the first and second carriage pieces can be moved upward or downward along the mounting bar. Upon moving the first and/or second carriage pieces to a desired height, a further rotation of the corresponding knobs in a second direction causes the first and second securing pins to be tightened such that the first and second carriage pieces are locked in position at the desired height.

The head pad and the back pad further comprise cushioned pads.

Various objects, features, aspects, and advantages of the inventive subject matter will become more apparent from the following detailed description of preferred embodiments and the accompanying drawing figures in which like numerals represent like components.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims. As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples or exemplary language (for example, "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Various terms are used herein. To the extent a term used in a claim is not defined, it should be given the broadest definition persons in the pertinent art have given that term as reflected in printed publications and issued patents at the time of filing.

Figure 1A:
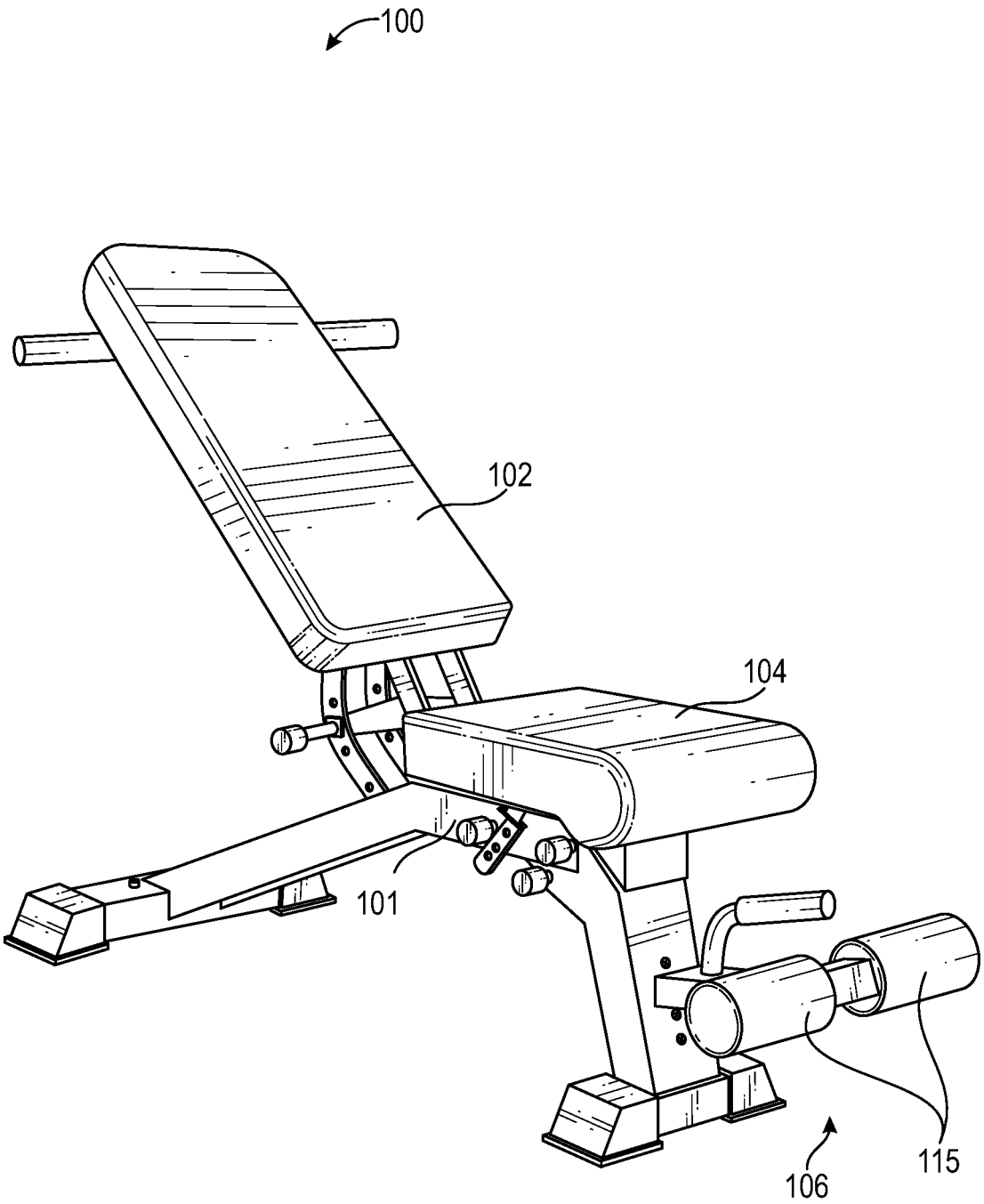
FIG. 1A illustrates an adjustable exercise bench in accordance with an embodiment.
Figure 1B:
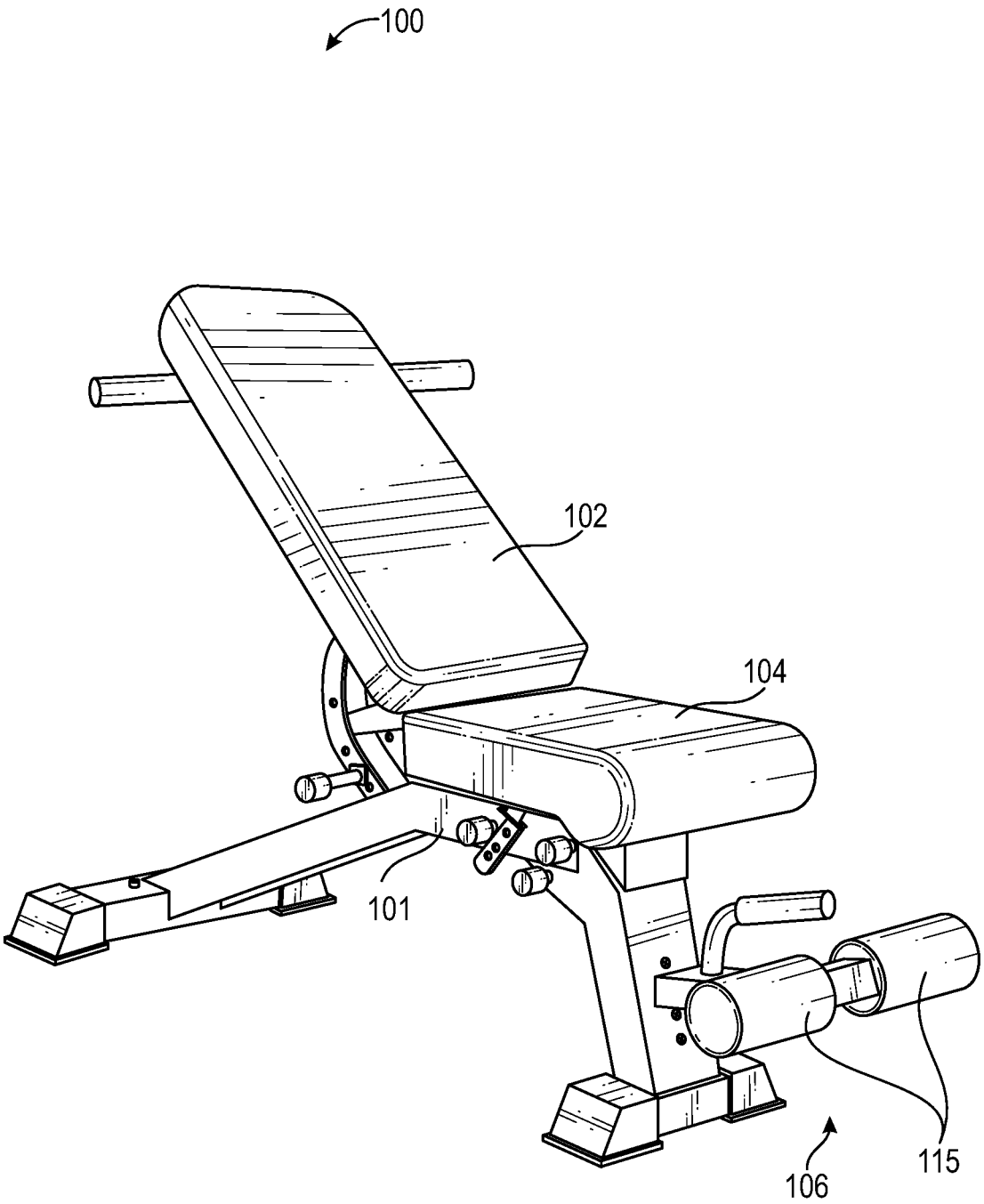
FIG. 1B illustrates an adjustable exercise bench in accordance with an embodiment.

FIG. 1A illustrates an exemplary adjustable exercise bench 100 in accordance with an embodiment. FIG. 1B illustrates another view of the exercise bench 100. As shown in FIGS. 1A-1B, the exercise bench 100 can include a basal frame 101. A seat 104 is attached to the basal frame 101. The height of the seat 104 can be adjusted (for example, moved between 0 degrees to 30 degrees) depending on a user's requirements. A vertical mounting bar 220 can be coupled to the basal frame 101. The vertical mounting bar 220 is configured to support a carriage assembly (201, further described with reference to FIGS. 2, 4A, and 4B) for an adjustable backrest 102.

Conventional adjustable exercise benches have a singular/unitary backrest. The backrest of conventional adjustable benches can be inclined or reclined but the overall height of the backrest cannot be adjusted or changed based on the user's height. Advantageously, the exercise bench 100 has a backrest 102 that can be adjusted to accommodate users having varying heights. For instance, backrest 102 can be slided or moved upward (that is away from the seat 104) or downward (that is close to the seat 104) such that there is either a gap between the backrest 102 and the seat 104 or the gap between the backrest 102 and seat 104 is substantially eliminated.

Figure 2:
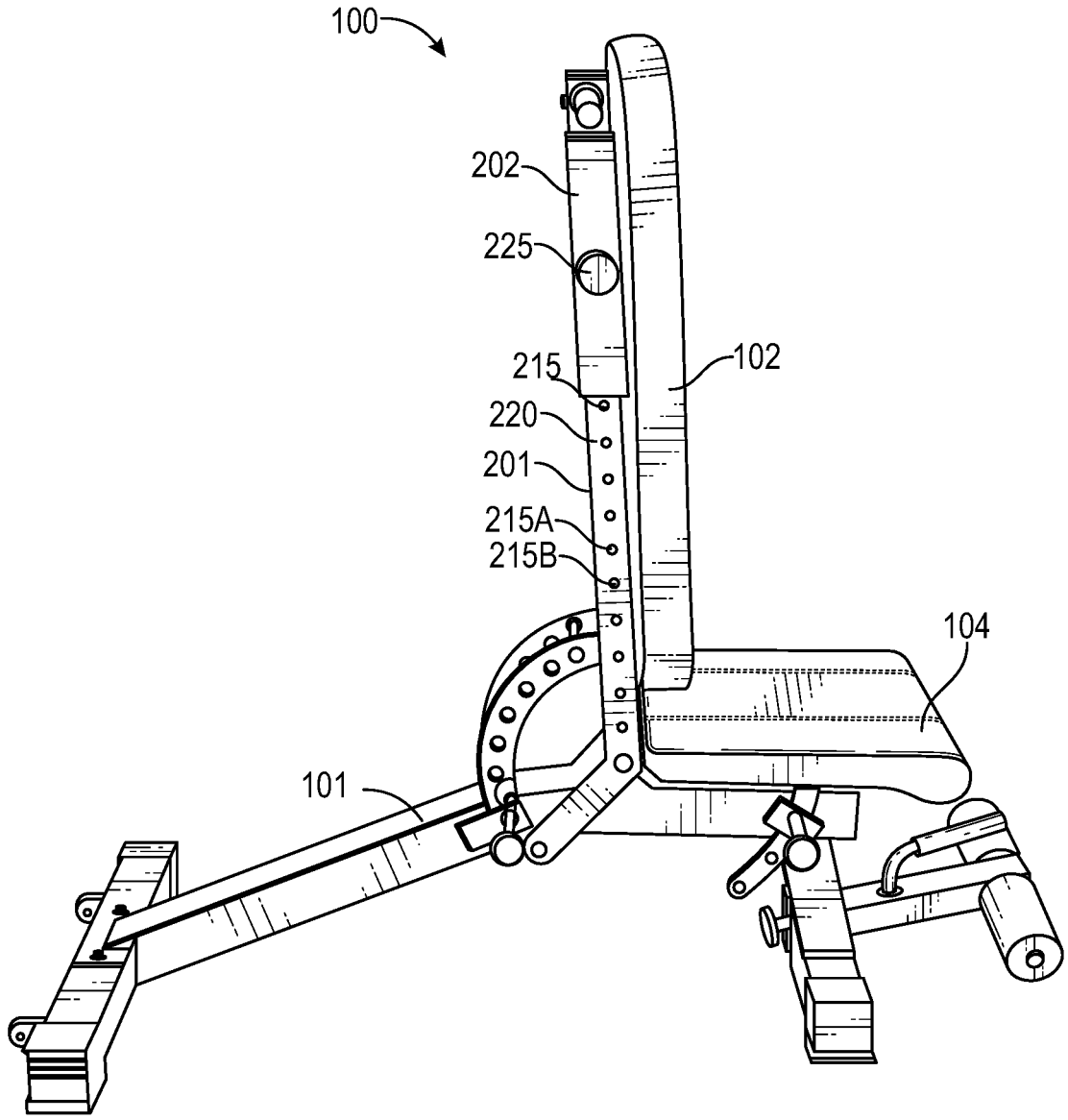
FIG. 2 illustrates an adjustable exercise bench in accordance with an embodiment.

FIG. 2 illustrates a side view of the carriage assembly 201 of the exercise bench 100. The carriage assembly 201 can include a slidable bracket or carriage piece 202 mounted over the mounting bar 220. The slidable carriage piece 202 is coupled to and carries the backrest 102 over the mounting bar 220. The carriage piece 202 is made of suitable durable and sturdy material, such as, steel or other suitable materials. The carriage piece 202 can be substantially tubular, square or rectangular-shaped members with a hollowed center that allows the carriage piece to be snugly fitted over the mounting bar 220.

According to an embodiment, a method of adjusting the height backrest 102 involves an initial step of providing the exercise bench 100 disclosed herein. The user can loosen a securing pin 225 by rotating its knob in a first direction. The user can then move the carriage piece 202, with the attached backrest 102, upward or downward, to a desired height (which can correspond to the user's height). The opening on the carriage piece 202 is aligned with a first hole 215A that corresponds to the desired height. The user inserts the securing pin 225 within the opening on the carriage piece 202. Since the opening is in alignment with the first hole 215A, the securing pin extends from the opening through the hole 215A. The user can further rotate the knob in a second direction to tighten the carriage piece 202 in position at the desired height.

Figure 3A:
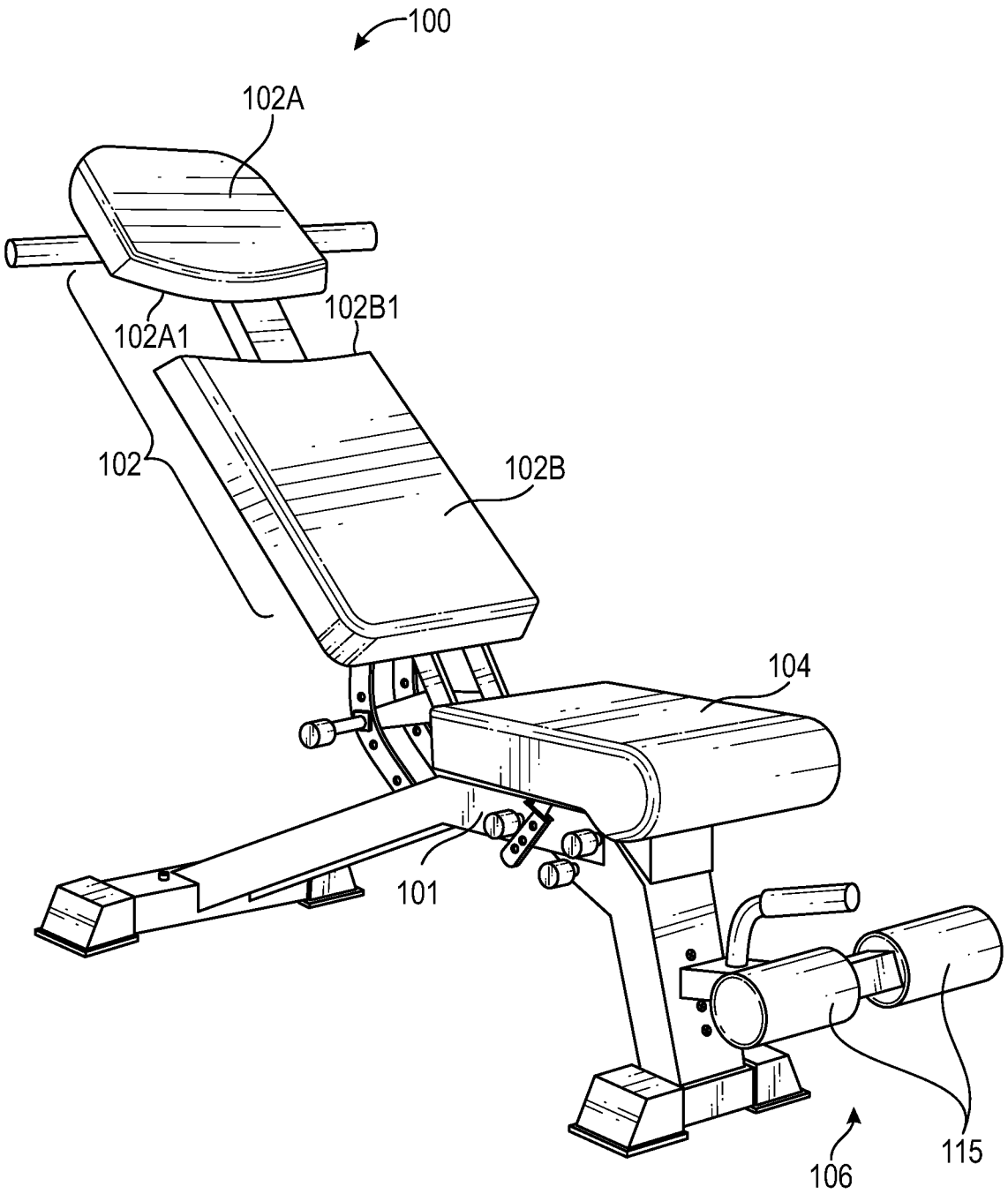
FIG. 3A illustrates an adjustable exercise bench in accordance with an embodiment.
Figure 3B:
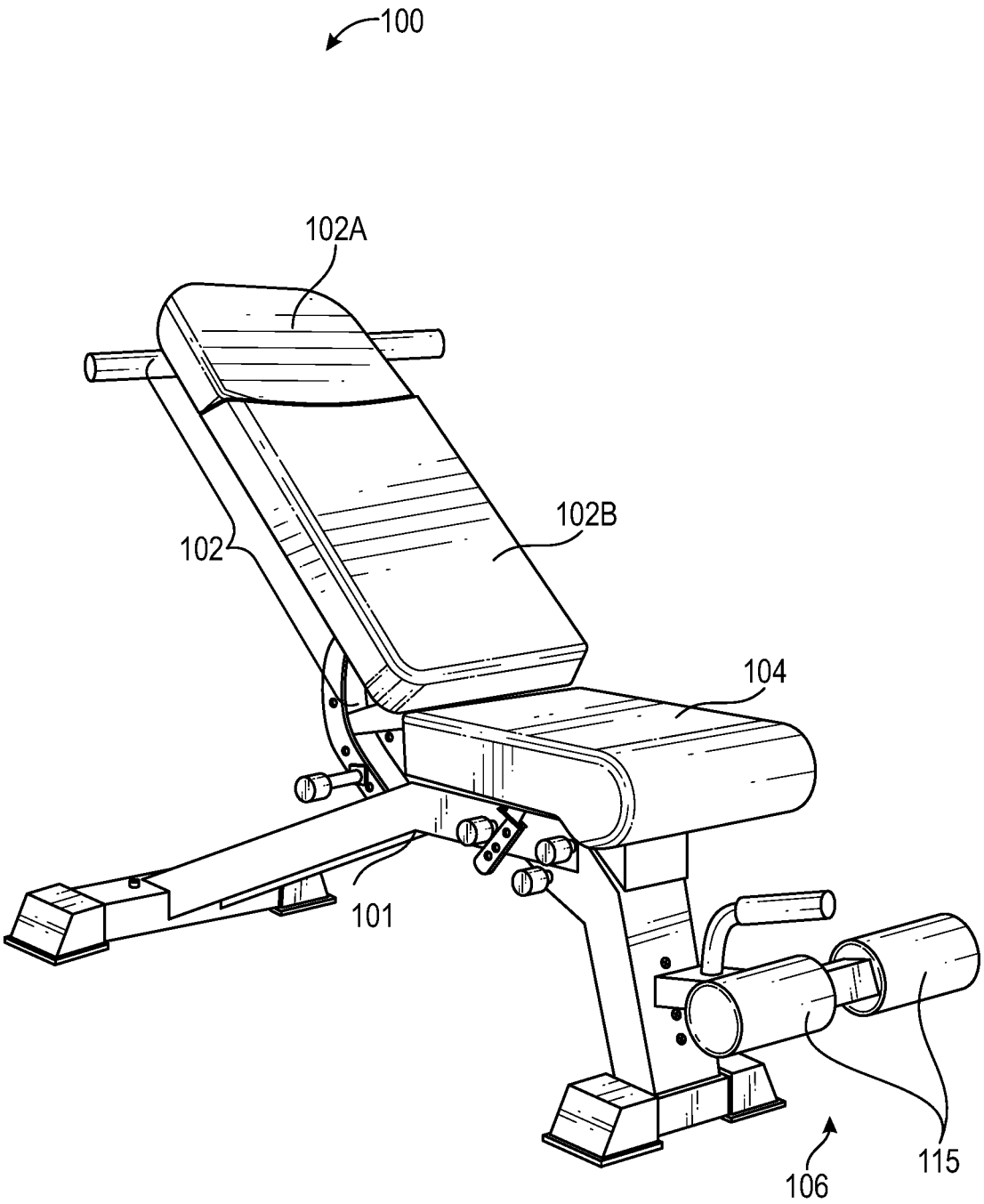
FIG. 3B illustrates the adjustable exercise bench, wherein the head pad and back pad are joined, in accordance with an embodiment.

FIG. 3A illustrates an exemplary adjustable exercise bench 100 in accordance with an embodiment. FIG. 3B illustrates another view of the exercise bench 100. As shown in FIGS. 3A-3B, the exercise bench 100 can include a basal frame 101. A seat 104 is attached to the basal frame 101. The height of the seat 104 can be adjusted (for example, moved between 0 degrees to 30 degrees) depending on a user's requirements. A vertical mounting bar 220 can be coupled to the basal frame 101. The vertical mounting bar 220 is configured to support a carriage assembly (201, further described with reference to FIGS. 4A and 4B) for an adjustable backrest 102.

Figure 4A:
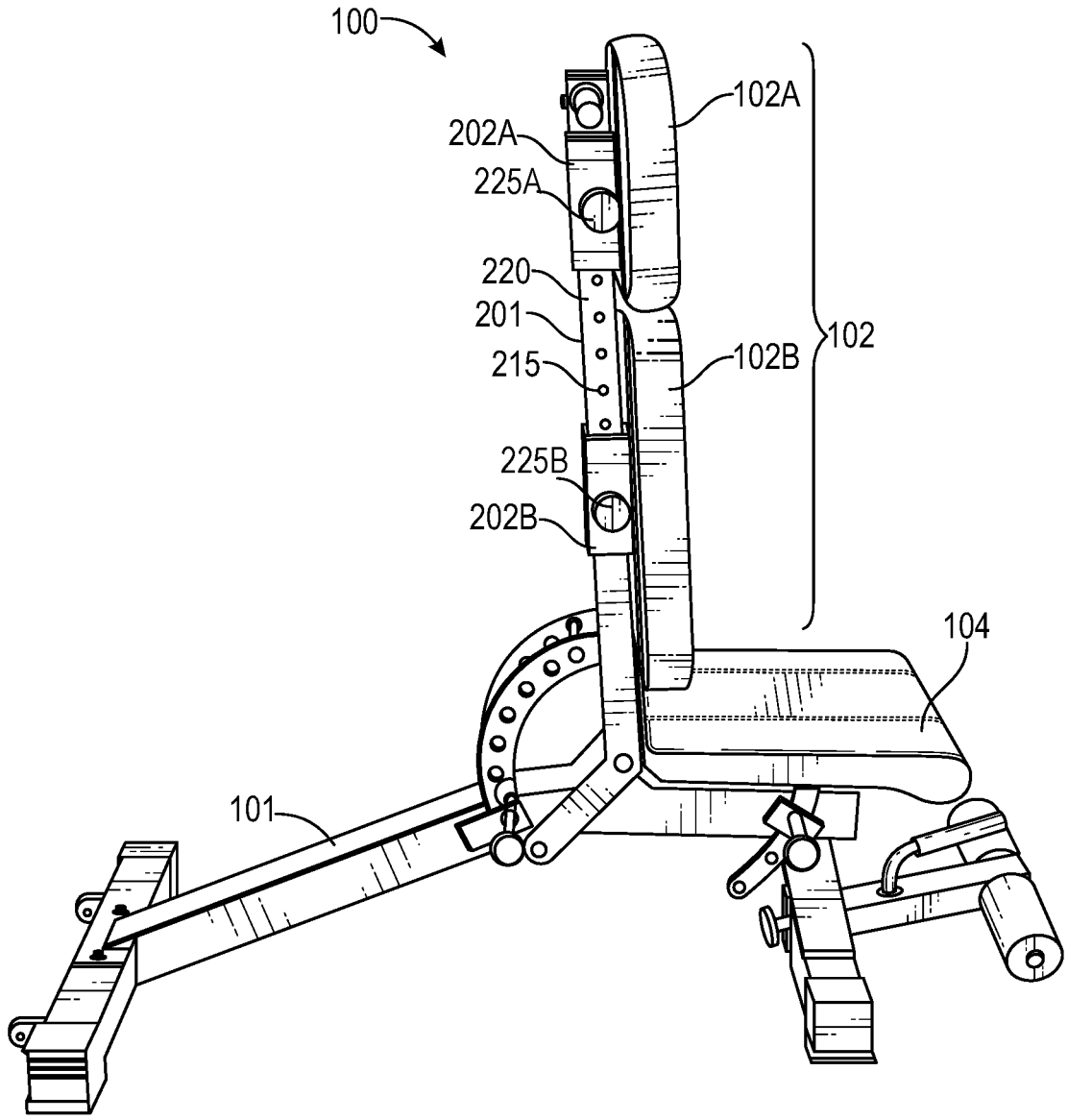
FIGS. 4A-4B illustrate side views of a carriage assembly for the adjustable exercise bench in accordance with an embodiment.
Figure 4B:
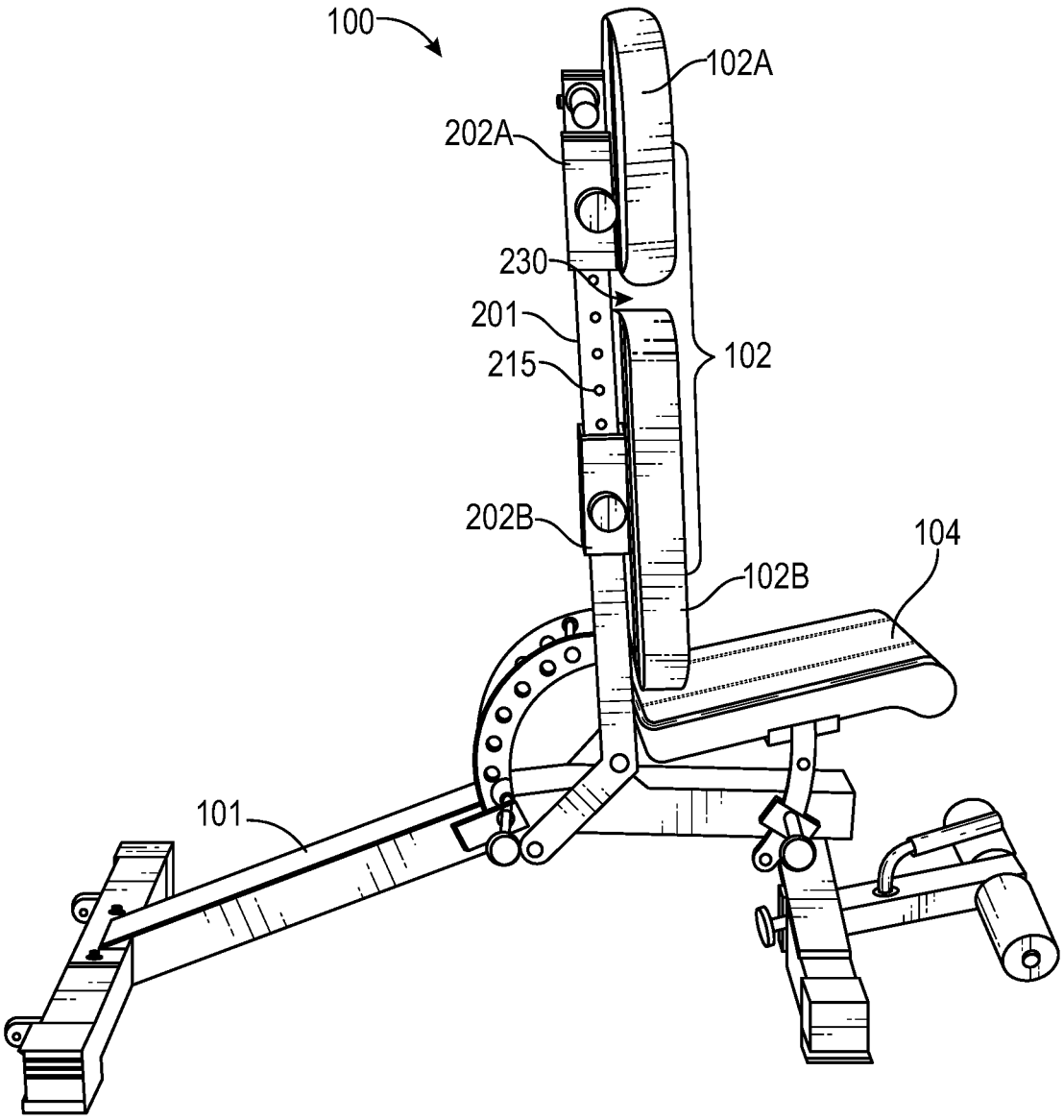

As shown in FIGS. 3A and 3B, the backrest 102 can include two slidable pads—a head pad 102A that is separated from a back pad 102B. The head pad 102A is designed to substantially support the head of the user while the back pad 102B is designed to substantially support the back of the user. The head pad 102A and the back pad 102B can each be moved upward or downward along the mounting bar 220 using carriage pieces (202A, 202B, as shown in FIGS. 4A, 4B). The back pad 102B can be moved or slided toward or away from the seat 104. In one or more embodiments, the seat 104 can also be moved or slided toward or away from the back pad 102B such that any gap between the backrest 102 and the seat 104 is decreased or increased. It is understood that the shape and other dimensions, such as, the height and width, of the head pad 102A and the back pad 102B are variable and all such variations are within the scope of the invention.

A lower surface 102A1 of the head pad 102A and an upper surface 102B1 of the back pad 102B are sized and shaped for a substantially close sliding reception. As shown in FIG. 3B the user (not shown) can move the head pad 102A and back pad 102B close together, as needed, such that the lower surface 102A1 of the head pad contacts or abuts the upper surface 102B1 of the back pad to form a substantially joined backrest 102. This allows the user of the exercise bench 100 to adjust the height(s) of the head and/or back pads to fit their own height or exercise requirements. The adjustable head pad 102A and back pad 102B can further facilitate safety, comfort and proper form as the user can adjust their body into a position allowing for stability (such as, feet flat on the floor and/or head not hanging off the end of the bench).

The head pad 102A, back pad 102B and seat 104 are padded or comprise cushioned pads. The pads can be made of any suitable material that is firm but also allows for a comfortable workout experience for the user.

The exercise bench 100 may also have a leg attachment 106. The leg attachment 106 may allow the user to engage their legs while performing exercises on the exercise bench 100. The leg attachment 106 can have cylindrical pads 115 coupled to an outer surface for user comfort.

FIGS. 4A-4B illustrate side views of the carriage assembly 201 of the exercise bench 100. The carriage assembly 201 can include two slidable brackets or carriage pieces 202A, 202B mounted over the mounting bar 220. A first slidable carriage piece 202A is coupled to and carries the head pad 102A while a second carriage piece 202B is coupled to and carries the back pad 102B over the mounting bar 220. The first carriage piece 202A is positioned above the second carriage piece 202B. The carriage pieces 202A, 202B are made of suitable durable and sturdy material, such as, steel or other suitable materials. The carriage pieces 202A, 202B can be substantially tubular, square or rectangular-shaped members with a hollowed center that allows the carriage pieces to be snugly fitted over the mounting bar 220.

The mounting bar 220 can be cylindrical, columnar or cuboid. The mounting bar 220 can include multiple holes 215 drilled along its sidewalls. In one or more embodiments, the holes 215 can be through holes so the brackets can be reversed and accessible from either side of the mounting bar 220. Each hole 215 can be spaced apart substantially equidistant from an adjacent hole. In an embodiment, each hole 215 may be separated by one inch or one-half inch from an adjacent through hole. However, each of the holes need not be spaced apart at a substantially equal distance from an adjacent hole.

The two carriage pieces 202A, 202B have at least one opening (not shown) on their sidewalls for receiving a securing pin. For example, the first carriage piece 202A has an opening for receiving a first securing pin 225A, while the second carriage piece 202B has an opening for receiving a second securing pin 225B. The securing pins 225A, 225B are configured to fasten or lock the corresponding carriage pieces 202A (with the attached head pad 102A), 202B (with the attached back pad 102B) at a desired height/position on the mounting bar 220. The securing pins 225A, 225B can be pop-pins or removable pins. Pop-pins and removable pins are known in the art. In one or more embodiments, any conventional securing means, such as clamps, can be used to lock the carriage pieces in position at a desired height on the mounting bar 220. As shown in FIG. 4B, the head pad 102A and the back pad 102B can be moved such that there is a space or gap 230 between the two pads.

The pins 225A, 225B can include a rotatable knob. When the pins are loosened by rotating their knobs in a first direction (for example, a clockwise direction), the carriage pieces 202A, 202B can slide up or down the mounting bar 220. The carriage pieces can be locked in position at a desired height by rotating the knobs of the pins 225A, 225B in a second direction (for example, a counterclockwise direction). Depending on the user's requirements, only one or both carriage pieces can be moved up or down the mounting bar 220 and secured within a hole 215 at a desired height.

In another embodiment, the pins are configured without a rotatable knob. In this and other embodiments, the pins can secure the carriage pieces in position at a desired height without an additional locking or securing mechanism.

The exercise bench 100 can further include a mechanism for inclining or declining the unitary or bifurcated backrest. Any conventional mechanism known in the art can be used for inclining/declining the backrest.

According to an embodiment, a method of adjusting the height of head pad 102A involves an initial step of providing the exercise bench 100 disclosed herein. The user can loosen the first securing pin 225A by rotating its knob in a first direction. The user can then move the carriage piece 202A, with the attached head pad 102A, upward or downward, to a desired height (which can correspond to the user's height). The opening on the first carriage piece 202A is aligned with a first hole 215A that corresponds to the desired height. The user inserts the first securing pin 225A within the opening on the first carriage piece 202A. Since the opening is in alignment with the first hole 215A, the securing pin extends from the opening through the hole 215A. The user can further rotate the knob in a second direction to tighten the carriage piece 202A in position at the desired height.

According to an embodiment, a method of adjusting the height of back pad 102B involves an initial step of providing the exercise bench 100 disclosed herein. The user can loosen the second securing pin 225B by rotating its knob in a first direction. The user can then move the carriage piece 202B, with the attached back pad 102B, upward or downward, to a desired height where the user wishes to rest their back during their workout. The opening on the second carriage piece 202B is aligned with a second hole 215B that corresponds to the desired height. The user inserts the second securing pin 225B within the opening on the second carriage piece 202B. Since the opening is in alignment with the second hole 215B, the securing pin extends from the opening through the hole 215B. The user can further rotate the knob in a second direction to tighten the carriage piece 202B in position at the desired height.

It is understood that the head pad 102A and back pad 102B are configured for independent upward and downward slidable movement along the mounting bar.

In one or more embodiments, the carriage pieces may be motorized for convenience.

While the foregoing describes various embodiments of the invention, other and further embodiments of the invention may be devised without departing from the basic scope thereof. The scope of the invention is determined by the claims that follow. The invention is not limited to the described embodiments, versions, or examples, which are included to enable a person having ordinary skill in the art to make and use the invention when combined with information and knowledge available to the person having ordinary skill in the art.

The invention claimed is:

1. An adjustable exercise bench, comprising:
a vertical mounting bar, wherein the vertical mounting bar comprises a plurality of pre-drilled holes; and
a backrest mounted to the mounting bar,
wherein the backrest is configured for slidable upward and downward movement along the mounting bar,
wherein the backrest is bifurcated,
wherein the bifurcated backrest comprises an adjustable head pad and an adjustable back pad, and
wherein the head pad is coupled to a first carriage piece, and wherein the back pad is coupled to a second carriage piece.

2. The adjustable exercise bench according to claim 1, wherein a lower surface of the head pad and an upper surface of the back pad are sized and shaped for a substantially close sliding reception with each other.

3. The adjustable exercise bench according to claim 1, wherein the vertical mounting bar is pivotally attached to a basal frame.

4. The adjustable exercise bench according to claim 3, further comprising a seat, wherein the seat is attached to the basal frame.

5. The adjustable exercise bench according to claim 1, wherein each of the pre-drilled holes is spaced apart substantially equidistant from an adjacent hole on the mounting bar.

6. The adjustable exercise bench according to claim 1, further comprising a first and second securing pin.

7. The adjustable exercise bench according to claim 6, wherein the first and second securing pins are selected from a group consisting of pop-pins and removable pins.

8. The adjustable exercise bench according to claim 6, wherein the first carriage piece comprises at least one opening for receiving the first securing pin, and wherein the first securing pin is configured to pass through a first hole of the pre-drilled holes on the mounting bar upon alignment of the opening on the first carriage piece with the first hole.

9. The adjustable exercise bench according to claim 6, wherein the second carriage piece comprises at least one opening for receiving the second securing pin, and wherein the second securing pin is configured to pass through a second hole of the pre-drilled holes on the mounting bar upon alignment of the opening on the second carriage piece with the second hole.

10. The adjustable exercise bench according to claim 6, wherein the first securing pin comprises a first knob and the second securing pins comprise a second knob.

11. The adjustable exercise bench according to claim 10, wherein rotating the first knob in a first direction causes the first securing pin to be loosened such that the first carriage piece can be moved upward or downward along the mounting bar.

12. The adjustable exercise bench according to claim 10, wherein rotating the second knob in a first direction causes the second securing pin to be loosened such that the second carriage piece can be moved upward or downward along the mounting bar.

13. The adjustable exercise bench according to claim 11, wherein upon moving the first carriage piece to a first hole of the pre-drilled holes at a desired height on the mounting bar, a further rotation of the first knob in a second direction causes the first carriage piece to be locked in position at the desired height.

14. The adjustable exercise bench according to claim 12, wherein upon moving the second carriage piece to a second hole of the pre-drilled holes at a desired height on the mounting bar, a further rotation of the second knob in a second direction causes the second carriage piece to be locked in position at the desired height.

15. The exercise bench according to claim 2, wherein the head pad and the back pad further comprise cushioned pads.

* * * * *